US008936521B2

(12) United States Patent
Lee

(10) Patent No.: US 8,936,521 B2
(45) Date of Patent: Jan. 20, 2015

(54) FOLDABLE GOLF TEE

(71) Applicant: Abraham C. Lee, Plano, TX (US)

(72) Inventor: Abraham C. Lee, Plano, TX (US)

( * ) Notice: Subject to any disclaimer, the term of this patent is extended or adjusted under 35 U.S.C. 154(b) by 0 days.

(21) Appl. No.: 13/925,204

(22) Filed: Jun. 24, 2013

(65) Prior Publication Data

US 2014/0378247 A1 Dec. 25, 2014

(51) Int. Cl.
*A63B 57/00* (2006.01)

(52) U.S. Cl.
CPC ..... *A63B 57/0018* (2013.01)
USPC ..... 473/396; 473/397

(58) Field of Classification Search
CPC ..... A63B 57/00
USPC ..... 473/387–403; D21/717
See application file for complete search history.

(56) References Cited

U.S. PATENT DOCUMENTS

| | | | | | |
|---|---|---|---|---|---|
| 1,866,143 | A | * | 7/1932 | Willey | 473/397 |
| 2,146,736 | A | * | 2/1939 | Hammond et al. | 473/397 |
| 2,712,939 | A | * | 7/1955 | Harp | 473/265 |
| 2,839,304 | A | * | 6/1958 | Lester | 473/397 |
| 3,406,977 | A | * | 10/1968 | Voelkerding | 473/257 |
| 3,414,268 | A | * | 12/1968 | Chase | 473/396 |
| 3,966,214 | A | * | 6/1976 | Collins | 473/397 |
| 4,645,208 | A | * | 2/1987 | Morabeto | 473/397 |
| D301,046 | S | * | 5/1989 | Morabeto | D21/718 |
| 6,899,644 | B1 | * | 5/2005 | Song et al. | 473/397 |
| 8,439,771 | B1 | * | 5/2013 | Fleming | 473/397 |
| 8,460,127 | B2 | * | 6/2013 | Kumar | 473/396 |
| 2005/0261089 | A1 | * | 11/2005 | Homby | 473/387 |
| 2006/0058120 | A1 | * | 3/2006 | Anton | 473/386 |
| 2007/0004538 | A1 | * | 1/2007 | Lim | 473/387 |
| 2007/0270246 | A1 | * | 11/2007 | Salmon | 473/397 |
| 2008/0146383 | A1 | * | 6/2008 | Dandelius | 473/397 |
| 2012/0064985 | A1 | * | 3/2012 | Kumar | 473/257 |
| 2013/0331206 | A1 | * | 12/2013 | Kumar | 473/396 |

FOREIGN PATENT DOCUMENTS

| | | | | |
|---|---|---|---|---|
| DE | 10338642 | A1 | * | 3/2005 |
| GB | 2376187 | A | * | 12/2002 |
| GB | 2408944 | A | * | 6/2005 |
| KR | 2004026023 | A | * | 3/2004 |
| KR | 701333 | B1 | * | 4/2007 |
| KR | 460835 | Y1 | * | 11/2012 |

* cited by examiner

*Primary Examiner* — Steven Wong

(57) ABSTRACT

Disclosed is a golf tee foldable, through rotation, in a direction of a drive swing to prevent breakages and loss and increase the drive shot distance. The golf tee comprises a ball platform; a supporting pillar connecting the ball platform to a coupling ball; and a ball coupling portion having a fixation pin. The ball is coupled to the ball coupling portion via an elongate burrow circumferentially defined on the outer surface of the ball, which mates with an elongate ridge formed on a hemispherical inner surface of the ball coupling portion. At the stroke of a drive swing, the burrow slides over the relatively shorter ridge to allow rotation of the coupling ball and supporting pillar, causing the golf tee be fold in a direction of the drive swing.

12 Claims, 4 Drawing Sheets

FOLDABLE GOLF TEE

FIELD OF INVENTION

This invention relates to a golf tee, and more particularly, to a foldable golf tee for facilitating a drive swing and preventing physical breakage and loss of the tee.

BACKGROUND

A tee shot is the first strike of every hole in golf, for which a golf tee supporting a golf ball at a certain height from the tee ground is used. Typically, a golf tee includes a fixation portion whose distal end is inserted into the ground to fix the tee and a concave supporting portion integrally formed with the fixation portion, on which a golf ball is placed for a golfer to strike a drive shot in a desired direction. When the head of a gold club hits the tee body exposed above the ground, which happens all too often in a golf game, the golf tees, typically made of wood or plastics, are easily broken to become non-reusable. Even if the tees are not broken, they are easily dislodged out of the ground, flown far away, and lost. An inexperienced golfer may easily spend more than a boxful of golf tees in a single eighteen-hole game because of the breakages or loss of the tees, which could inflict a considerable economic loss.

Therefore, there is a need to provide a golf tee that is structured not to be easily broken or lost by a mishit drive swing.

BRIEF DESCRIPTION OF THE DRAWINGS

The present disclosure is best understood from the following detailed description when read with the accompanying figures. It is emphasized that, in accordance with the standard practice in the industry, various features are not drawn to scale and are used for illustration purposes only. In fact, the dimensions of the various features may be arbitrarily increased or reduced for clarity of discussion.

DETAILED DESCRIPTION

Figure 1:
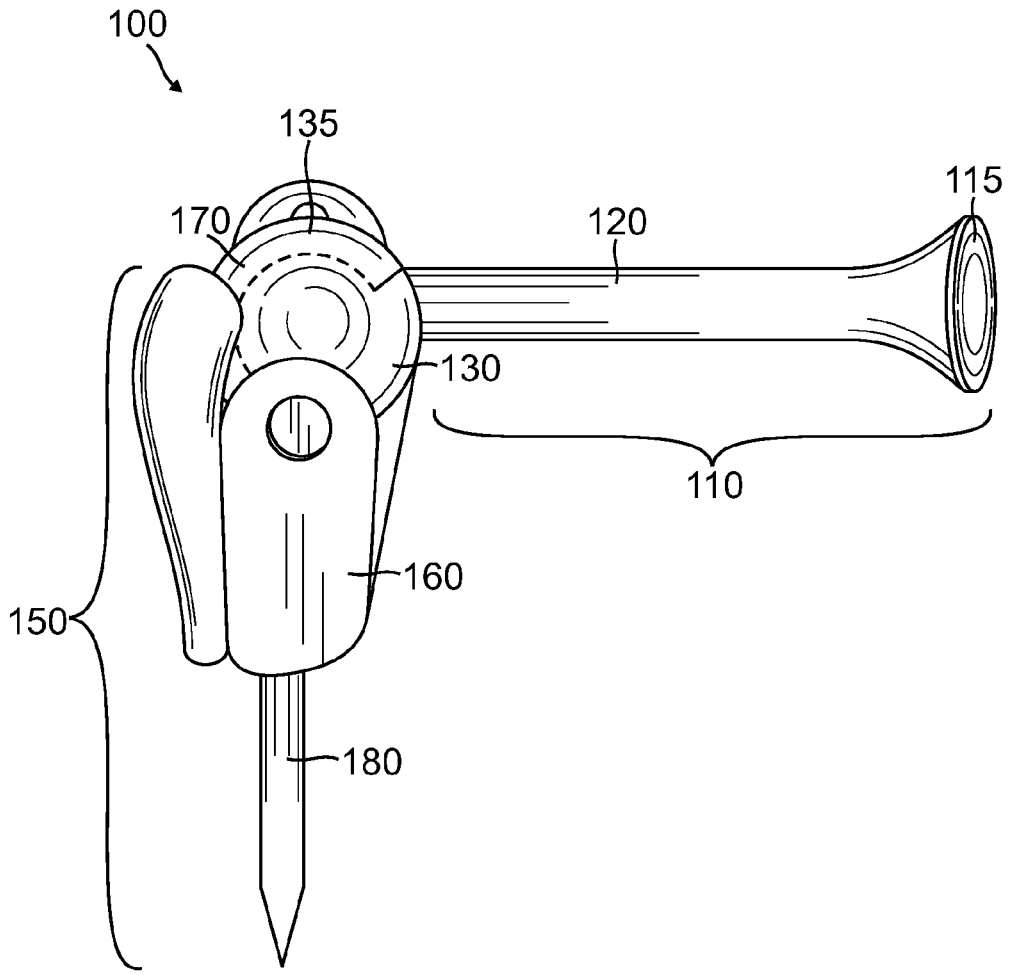
FIG. 1 is a perspective side view of a golf tee made according to an embodiment of the present disclosure.

It is understood that the following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure repeats reference numerals and/or letters for the equivalent, similar, or corresponding parts/elements in the various examples illustrated in figures. This repetition, however, is for the sake of simplicity and clarity and does not in itself dictate a relationship between the various embodiments and/or configurations discussed. Moreover, various features may be arbitrarily drawn in different scales for the sake of simplicity and clarity.

The present disclosure provides a golf tee that is designed to be foldable in a direction of a drive swing to prevent breakages and loss of the tee from the strike and increase the drive shot distance by the reduced resistance of the tee at the moment of the strike.

Now referring to the figures, FIG. 1 is a perspective side view of a golf tee 100 made in accordance with an embodiment of the present disclosure. The golf tee 100 comprises an upper portion 110, a coupling ball 130 and a lower portion 150. The upper portion 110 comprises a ball platform 115 sized and configured to place a golf ball thereon and a supporting pillar 120. The ball platform 115 has, typically, the shape of a disc, which is slightly dented at the center of its top surface to secure a golf ball. But depending on embodiments, the ball platform 115 may have different shapes. The supporting pillar 120 is an elongated body extending substantially perpendicularly, at its proximal end 122, from the bottom of ball platform 115 to the coupling ball 130 at its opposing distal end 124. In an embodiment, the supporting pillar 120 has the shape of a cylindrical bar as shown in FIG. 1. But in other embodiments it may have other cross-sectional shapes, instead of a circle, such as a square, a triangle, or other polygons.

In an embodiment, the supporting pillar 120 and the ball platform 115 are integrally formed, but in another embodiment, they may be separately formed and attached together by a suitable connecting means. Typically, the supporting pillar 120 and the ball platform 115 are fabricated of wood, plastics, or other synthetic resins or materials. But they could be made of metals or any other suitable materials known in the art as capable of withstanding the impact from the head of a golf club at a drive swing.

The coupling ball 130, shaped as a substantially spherical ball, is fixed to the distal end 124 of the supporting pillar 120 so that they may move or rotate together. In an embodiment, the coupling ball 130 may be integrally formed with the supporting pillar 120, but in anther embodiment, it may be detachably fastened to the supporting pillar 120 via a fixation means such as a connecting pin (not shown), of which one end may be fixed into a hole defined into the coupling ball 130 and the other end may be threadedly fastened to the distal end 124 of the supporting pillar 120 via an external male thread formed on the outer surface of the pin and an internal female thread formed on an inner surface of a hole defined at the distal end 124 of the supporting pillar 120. The size of the coupling ball 130 is suitably determined in consideration of the overall size of the tee 100. In an embodiment, the diameter of the coupling ball 130 may be slightly bigger than the diameter of the ball platform disc 115 for structural stability.

Figure 2A:
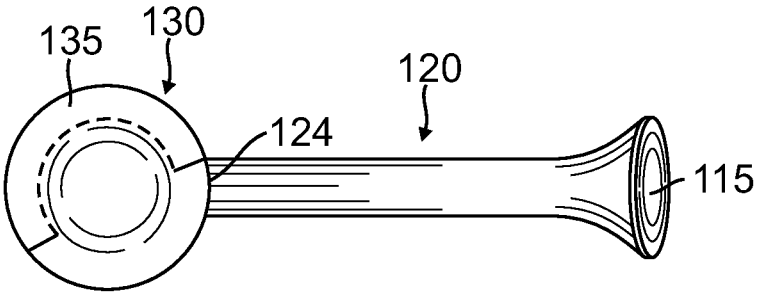
FIG. 2A is a perspective side view of portions of a golf tee made according to an embodiment of the present disclosure.

The coupling ball 130 has an elongate burrow 135 defined thereon for rotatably coupling the ball 130 to the lower portion 150 of the tee 100 thereby. FIG. 2A is a perspective side view of the coupling ball 130 and the upper portion 110 that comprises the ball platform 115 and the supporting pillar 120, made in an embodiment of the present disclosure. The elongate burrow 135, shown as dotted line in FIG. 2A, is circumferentially defined along the outer surface of the coupling ball 130, penetrating into the center of the ball 130. Therefore, the burrow 135 has a spherical contour. In an embodiment, the burrow 135 extends, circumferentially from the portion of the coupling ball 130 where the supporting pillar 120 is joined toward an opposite portion on the ball 130. The dimensions of the circumferential length, width, and depth of the burrow 135 may vary depending on the dimension of the coupling ball 130 and the golf tee 100 as well as on different embodiments. In an embodiment, the burrow 135 may have a length ranging from about one half to two thirds of the circumferential length of the coupling ball 130 as shown in FIG. 2A. Also, in an embodiment, the elongate burrow 135 may have a depth ranging between about a one tenth and about one third of the diameter of the coupling ball 130. Similarly, the elongate burrow 135 may have a width ranging between about a one tenth and about one third of the diameter of the coupling ball 130. For example, in an embodiment, the ball platform 115 may have a diameter of about 1 centimeter (cm) and the coupling ball 130 may have a diameter 1.2~1.5 cm. In this embodiment, the elongated burrow 135 may have a depth of about 0.3 cm and a width of about 0.4 cm.

Figure 2B:
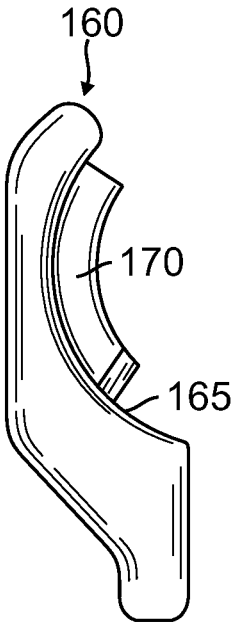
FIG. 2B is a perspective side view of portions of a golf tee made according to an embodiment of the present disclosure.

The lower portion 150 of the tee 100 comprises a ball coupling portion 160 and a fixation pin 180. The ball coupling portion 160 couples the coupling ball 130 such that the ball 130, while still engaged with the coupling portion 160, is rotatable only in one direction, the direction of a drive swing. FIG. 2B is a perspective side view of the ball coupling portion 160 made according to an embodiment of the present disclosure. The ball coupling portion 160 has a substantially hemispherical inner surface 165 sized and configured to receive the coupling ball 130 thereon. To couple the coupling ball 130, the ball coupling portion 160 has an elongate, semicircular protrusion or ridge 170 formed on the inner surface 165 along its center line. The ridge 170 lengthwise extends vertically towards the ground in the direction to which the fixation pin 180 extends. The ridge 170 is sized and configured to engage and mate with the elongate burrow 135 on the coupling ball 130 such that the coupling ball 130, while securely engaged with the coupling portion 160, is rotatable in the direction of the ridge 170 and the burrow 135. More specifically, the ridge 170 is arched to conform to the semispherical contours of the inner surface 165 and the elongate burrow 135 and sized to fit in the burrow 135. For that, the width of the ridge 170 is set to be slightly less than the width of the elongate burrow 135 to allow a frictional engagement between them.

Figure 3A:
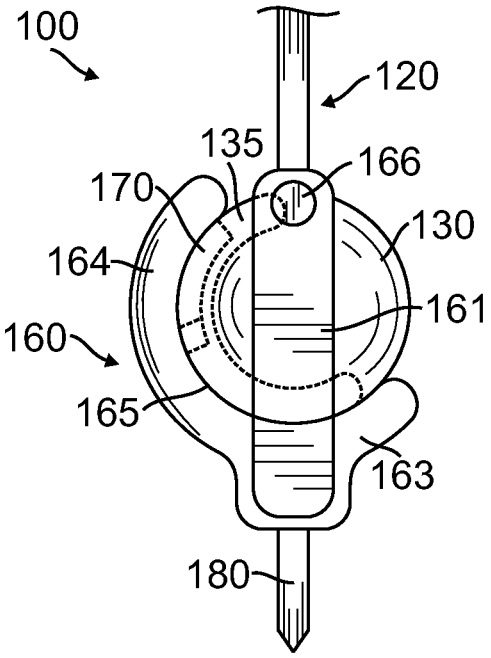
FIG. 3A is a side cross-sectional view of a lower portion of a golf tee, in a stand-by position, made according to an embodiment of the present disclosure.
Figure 3B:
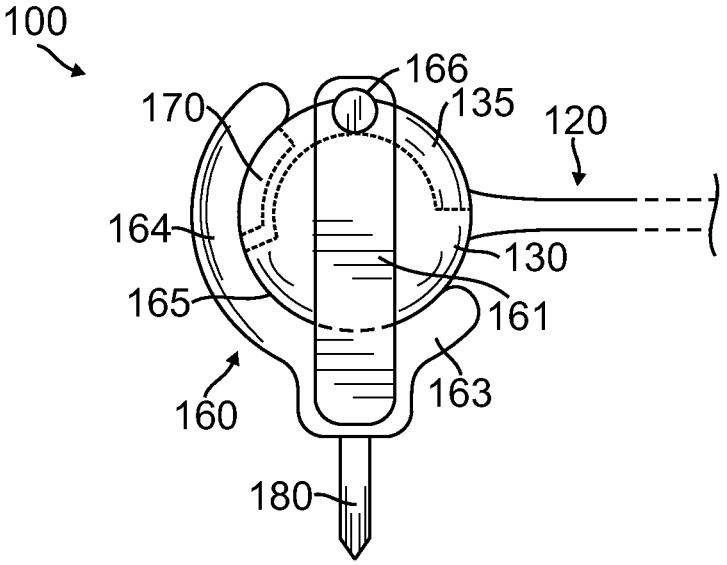
FIG. 3B is a side cross-sectional view of a lower portion of a golf tee, in an after-shot position, made according to an embodiment of the present disclosure.
Figure 3C:
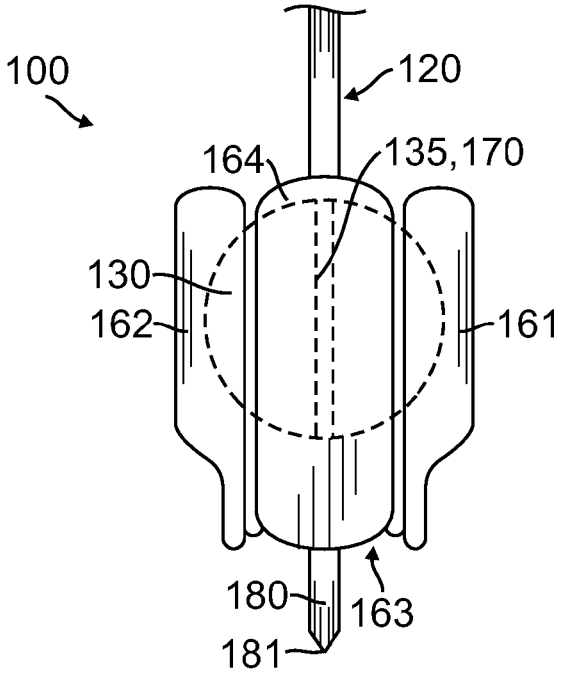
FIG. 3C is a rear view of a lower portion of a golf tee, in a stand-by position, which is made in accordance with an embodiment of the present disclosure.
Figure 3D:
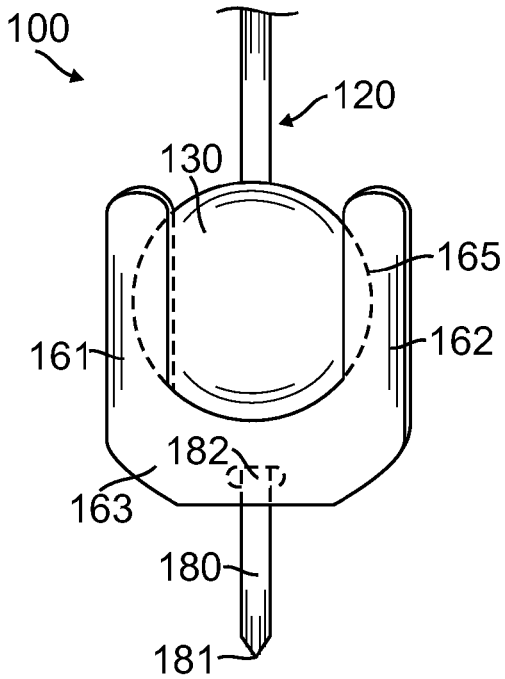
FIG. 3D is a front view of a lower portion of a golf tee, in a stand-by position, which is made in accordance with an embodiment of the present disclosure.

FIGS. 3A-3D are schematic cross-sectional views, at various angles, of a lower portion of the golf tee 100 made in accordance with embodiments of the present disclosure, which show a lower portion of the supporting pillar 120 adjacent its distal end, a coupling ball 130, an elongate burrow 135, an elongate ridge 170, a ball coupling portion 160, its inner surface 165, and a fixation pin 180. FIG. 3A is a side cross-sectional view of the lower portion of the golf tee 100 in a stand-by position before a drive swing when the supporting pillar 120 stands upright, holding a golf ball on the ball platform at its proximal end (not shown). FIG. 3B is a side cross-sectional view of the lower portion of the golf tee 100, in an after-shot position, where the supporting pillar 120 lies substantially parallel to the ground after having rotated, together with the coupling ball 130, by an angle of about 90 degrees due to an impact from a drive swing strike. After the drive swing, the supporting pillar 120, which has been folded through rotation as in FIG. 3B, rotates back and returns to the stand-by position as in FIG. 3A. In this way, the golf tee 100 in the present disclosure is prevented from breakages and losses commonly occurring to the conventional tees. FIGS. 3C and 3D are rear and front views, respectively, of the lower portion of the golf tee 100 in the stand-by position, which is made in accordance with an embodiment of the present disclosure.

Now referring to, FIGS. 3A-3D, the coupling ball 130 sits on the inner surface 165 of the ball coupling portion 160, while being tightly engaged thereto via frictional mating between the elongate burrow 135 and the elongate ridge 170. During the rotation, the elongate burrow 135 frictionally slides over the elongate ridge 170 while still engaging the latter. As shown in FIGS. 3A and 3B, the coupling ball 130 and the supporting pillar 120 rotates in only one direction, restricted by the configuration of the burrow 135 and the ridge 170. More specifically, the angular rotation is confined in a plane defined by the burrow 135 and the ridge 170, the plane of FIGS. 3A-3D. This is the direction of a drive shot. In order not to obstruct the rotation of the supporting pillar 120, the front side of the ball coupling portion 160 is made open, and as a consequence, the inner surface 165 receiving the coupling ball 130 is defined as a hemispherical surface.

In an embodiment, the elongate burrow 135 extends a length slightly greater than one half of the equator circumferential length of the coupling ball 130. In an embodiment, the length of the elongate ridge 170 is substantially smaller than the length of the elongate burrow 135, as shown in FIG. 3A, so as to allow a sufficient rotation angle of the coupling ball 130. On the other hand, the length of the elongate ridge 170 is set to be long enough to prevent the disengagement of the coupling ball 130, especially at the time of the impact on the tee 100 during a drive shot. In an embodiment, the length of the elongate ridge 170 may range between about a fourth and one half of the length of the elongate burrow 135. In one embodiment, the position and the length of the elongate ridge 170 are set just right such that when the supporting pillar 120 rotates by about 90 degrees to lie substantially parallel to the ground, the elongate ridge 170 may reach the end of the burrow 135, as shown in FIG. 3B, and thereby stop further rotation of the coupling ball 130.

In one embodiment, the ball coupling portion 160 may comprise four portions: opposing left and right portions 161, 162, a bottom portion 163, and a back portion 164 disposed between the left and right portions 161, 162. The respective inner surfaces of the four portions, 161, 162, 163, and 164 are spherically concave such that they, when connected, may form the substantially spherical inner surface 165 of the ball coupling portion 160 to receive the coupling ball 130 thereon. As shown in FIG. 3C, the elongate ridge 170 is formed on the inner surface of the back portion 164 along a vertical central line thereof. The front view of the golf tee 100, illustrated in FIG. 3D, shows that the front side of the ball coupling portion 160 is open or unobstructed to allow the rotation of the supporting pillar 120 toward the front side.

In an embodiment, shown in FIGS. 2C and 2D, the bottom portion 163 may be integrally formed with the left and right portions 161 and 162, whereas the back portion 164 is formed as a separate piece and attached to the other portions by suitable fixture means known in the art. For instance, the back portion 164 may be threadedly attached to the bottom portion 163 via one or more screws. When attached together, the four portions, in unison, form the ball-receiving inner surface 165. In another embodiment, shown in FIGS. 2A and 2B, the bottom portion 163 may be integrally formed with the back portion 164, whereas the left and right portions 161 and 162 are formed as separate pieces and attached to the other two portions 163 and 164 by suitable fixture means known in the art. In still another embodiment (not shown), the entire ball coupling portion 160 may be integrally formed.

In one embodiment, a hole 166 may be formed adjacent the top of each of the left and right portions 161 and 162, as shown in FIGS. 2A and 2B, to facilitate insertion of the coupling ball 130 between the left and right portions 161 and 162 and engagement with the ball coupling portion 160 via the elongate burrow 135 and the elongate ridge 170. With such holes 166, the left and right portions 161 and 162 are provided with resilience to accept the coupling ball 130 more easily.

The fixation pin 180 extends, at its proximal end 182, from the bottom portion 163 towards the ground. The pin 180 has, in one embodiment, a generally cylindrical bar shaped body and a sharp, wedge-shaped distal end 181 to be inserted into the ground. But in other embodiments, the pin 180 may have other geometrical cross-sectional shapes, such as a triangle or a square, as long as it is configured to penetrate the ground and provide a sufficient support and fixation to the golf tee 100. The proximal end 181 of the pin 180 is fixed to the bottom portion 163 of the ball coupling portion 160 by a suitable fixation means known in the art. For example, in an embodiment, the proximal end of the fixation pin 180 may be threadedly fixed into a hole defined into the bottom portion 163 of the ball coupling portion 160 as schematically shown in FIG. 3D.

The various parts of the golf tee in the present invention including the supporting pillar 120, the coupling ball 130, the ball coupling portion 160, the elongate ridge 170, and/or the fixation pin 180 are fabricated, typically, of wood, plastics, or other synthetic resins or materials. But they could be made of metals or any other materials known in the art to be suitable for withstanding the impact from a drive shot. For example, in one embodiment, the elongate ridge 170 may be integrally formed with the back portion 164 in plastics, or in another embodiment, the elongate ridge 170 may be made of a metal and inserted into the back portion 164 made of plastic while the latter is in a fluid state during its fabrication process.

The golf tee fabricated according to the present disclosure has many advantages over the conventional tees. The feature of the golf tee, particularly the supporting pillar, being folded through rotation at a drive shot in the direction of a drive swing, enables a more effective swing at less exertion from the golfer and increases the drive shot distance by the reduced resistance of the tee at the moment of the strike. Further, since the folded tee returns to the original stand-by position for reuse after the strike, the breakage and loss for the conventional tees, which caused not only economic loss but also environmental contaminations from the tee debris, are prevented.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A rotatable golf tee, comprising:

a dented ball platform sized and configured to place a golf ball thereon;

a supporting pillar extending, at a proximal end thereof, from the ball platform;

a spherical coupling ball joining the supporting pillar at a distal end thereof, the coupling ball having an elongate burrow circumferentially defined along an outer surface of the coupling ball and extending from adjacent the distal end of the supporting pillar toward an opposite side of the coupling ball;

a ball coupling portion having a substantially hemispherical inner surface sized and configured to receive the coupling ball thereon, the inner surface having thereon an elongate ridge sized and configured to engage the elongate burrow such that the coupling ball is rotatable thereby only in a first plane while being engaged with the coupling portion; and a fixation pin extending from the ball coupling portion, the pin being configured to be inserted into a ground to fix the golf tee.

2. The golf tee of claim 1, wherein the supporting pillar is integrally formed with the coupling ball.

3. The golf tee of claim 1, wherein the elongate burrow has a length of about one half of the outer circumference of the coupling ball.

4. The golf tee of claim 1, wherein the elongate burrow has a depth ranging between about one tenth and about one third of the diameter of the coupling ball.

5. The golf tee of claim 1, wherein the elongate burrow has a width ranging between about one tenth and about one third of the diameter of the coupling ball.

6. The golf tee of claim 1, wherein the coupling ball has a diameter larger than the diameter of the ball platform.

7. The golf tee of claim 1, wherein the elongate ridge has a length substantially smaller than the length of the elongate burrow so as to allow the elongate burrow to slide on the elongate ridge during the rotation of the coupling ball.

8. The golf tee of claim 1, wherein the elongate ridge has such a length as to stop the rotation of the coupling ball when the supporting pillar is disposed substantially parallel to the ground.

9. The golf tee of claim 1, wherein the elongate ridge runs generally in a direction of the fixation pin's extension.

10. The golf tee of claim 1, wherein the substantially hemispherical inner surface is open at a side so as not to obstruct the rotation of the supporting pillar in the first plane.

11. The golf tee of claim 1, wherein the ball coupling portion comprises opposing left and right portions, a bottom portion integrally formed with the left and right portions, and a back portion disposed between the left and right portions, wherein the back portion has the elongate ridge.

12. The golf tee of claim 11, wherein each of the opposing left and right portions has a hole formed adjacent a top thereof to be provided with resilience and facilitate insertion of the coupling ball between the opposing left and right portions.

* * * * *